United States Patent [19]

Lakhan et al.

[11] Patent Number: 4,836,229

[45] Date of Patent: Jun. 6, 1989

[54] DISHWASHING APPARATUS INCLUDING A FLIP-TOP SOLID DETERGENT DISPENSER

[75] Inventors: Haresh C. Lakhan, Eagan; Lawrence W. Switala, Minneapolis, both of Minn.

[73] Assignee: Ecolab Inc., St. Paul, Minn.

[21] Appl. No.: 290,885

[22] Filed: Dec. 22, 1988

Related U.S. Application Data

[63] Continuation of Ser. No. 44,434, Apr. 30, 1987, abandoned.

[51] Int. Cl.[4] ..... A47L 15/44

[52] U.S. Cl. ..... 134/93; 134/95; 134/101; 134/104.4; 134/111; 222/52; 222/67; 222/185; 222/190

[58] Field of Search ..... 34/56 D, 93, 95, 98–102, 34/104.4, 111; 68/18 F; 137/268; 222/52, 67, 185, 190; 210/167

[56] References Cited

U.S. PATENT DOCUMENTS

| | | | |
|---|---|---|---|
| D. 244,598 | 6/1977 | Nystuen et al. | D15/199 |
| 1,662,496 | 3/1928 | Forsgard | 134/99 X |
| 1,672,286 | 6/1928 | Stringham et al. . | |
| 2,038,260 | 4/1936 | Ash | 134/99 X |
| 2,671,037 | 3/1954 | Stoddard | 134/25 |
| 2,718,481 | 10/1955 | Tuthill | 134/25 |
| 2,747,588 | 5/1956 | Bonner | 134/99 X |
| 2,770,242 | 11/1956 | Tubiolo | 134/101 X |
| 3,024,138 | 3/1962 | Schlott | 134/111 X |
| 3,085,416 | 4/1963 | D'Hooge | 68/13 |
| 3,313,311 | 4/1967 | Gilson | 134/109 |
| 3,355,324 | 11/1967 | Catzen | 134/29 |
| 3,575,185 | 4/1971 | Barbulesco | 134/111 X |
| 3,595,252 | 7/1971 | Conte | 134/109 |
| 3,595,438 | 7/1971 | Daley et al. | 222/67 |
| 3,810,480 | 5/1974 | Smith et al. | 210/167 X |
| 3,903,909 | 9/1975 | Noren et al. | 134/101 X |
| 3,949,772 | 4/1976 | Hartmann | 134/111 X |
| 4,020,865 | 5/1977 | Moffat et al. | 137/268 |
| 4,088,145 | 5/1978 | Noren | 134/104.4 |
| 4,147,559 | 4/1979 | Fraula et al. | 134/101 X |
| 4,156,621 | 5/1979 | Andrews et al. | 134/10 |
| 4,187,122 | 2/1980 | Query | 134/104.4 X |
| 4,277,290 | 7/1981 | Andrews et al. | 134/100 X |
| 4,615,744 | 10/1986 | Murtha | 134/25.2 |

*Primary Examiner*—Harvey C. Hornsby
*Assistant Examiner*—Stephen F. Gerrity
*Attorney, Agent, or Firm*—Merchant, Gould, Smith, Edell, Welter & Schmidt

[57] ABSTRACT

A dishwashing apparatus designed in such a manner as to have one incoming waterline and self cleaning filters. Solid additive sources are situated in containers mounted on top of the dishwashing apparatus and fed with water by means of a pump. A flip-top solid detergent dispenser comprising a base having a funnel-shaped interior, a nozzle positioned within the interior of the base, and a detergent container support connected by a hinge to the base can be mounted on the dishwashing apparatus. The detergent container support is designed to hold only a particular shaped detergent container and to prevent dripping of detergent solution upon the user. A circular metallic ring having a plurality of holes is situated around the funnel-shaped interior of the base. Water is flushed through the holes of the circular metallic ring at designated times to purge one of the filters of air and to insure that the detergent is rinsed down through the funnel-shaped interior of the base.

4 Claims, 7 Drawing Sheets

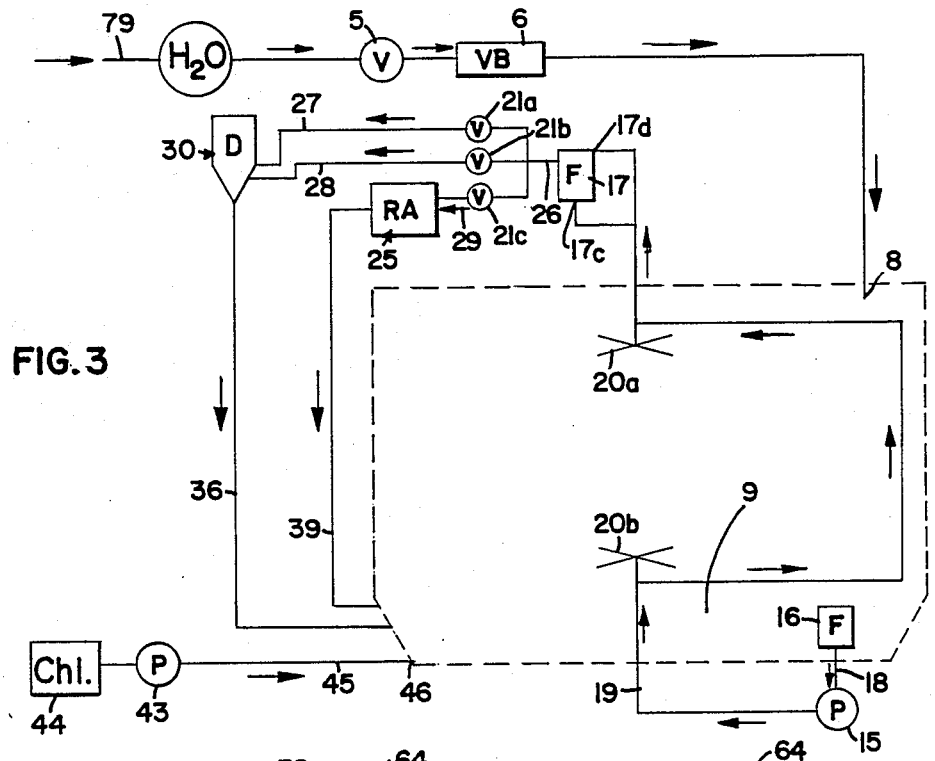
FIG. 3
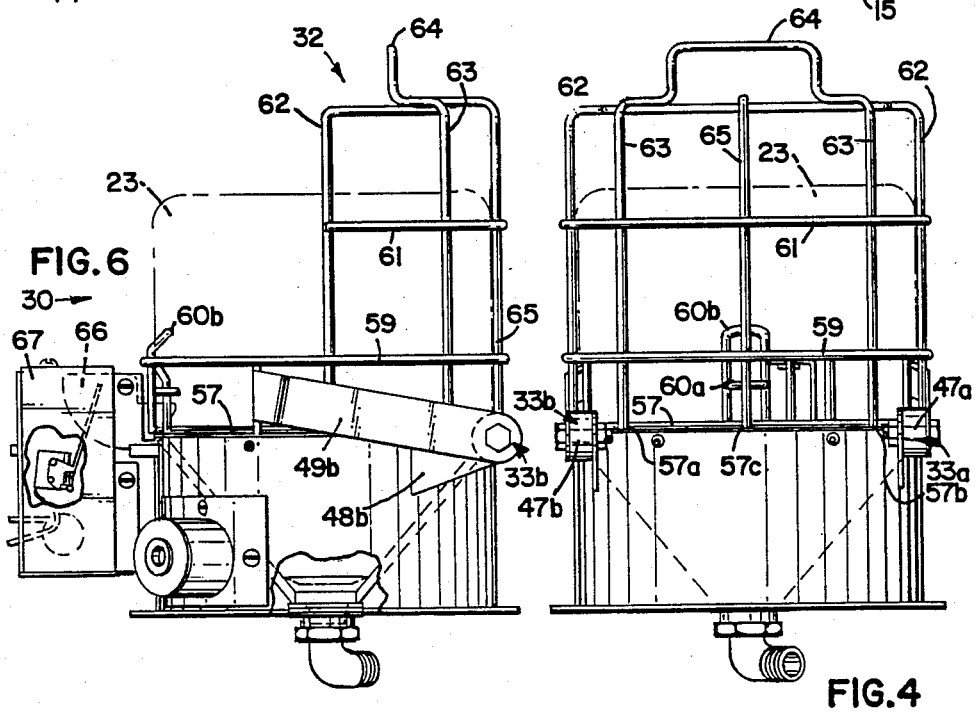
FIG. 6
FIG. 4

FIG. 7
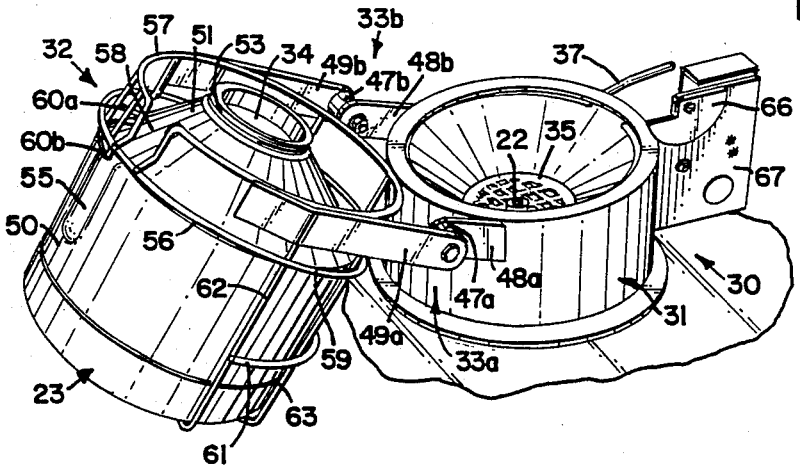
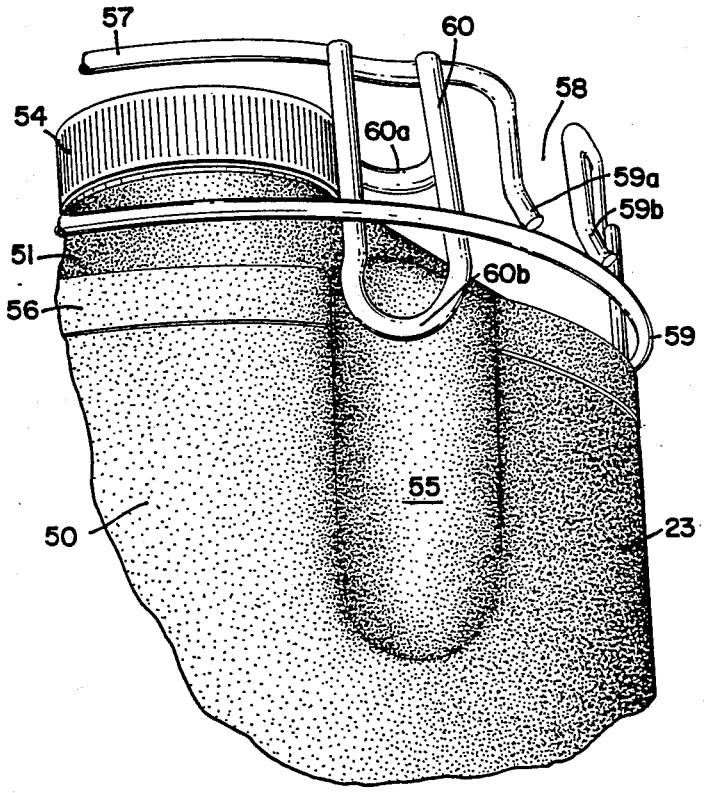
FIG. 8

DISHWASHING APPARATUS INCLUDING A FLIP-TOP SOLID DETERGENT DISPENSER

This is a continuation of application Ser. No. 07/044,434, filed Apr. 30, 1987, now abandoned.

BACKGROUND OF THE INVENTION

1. Field of the Invention

This invention relates generally to a dishwasher apparatus, more particularly to a dishwasher apparatus having only one incoming water line and using a pump to circulate water against various additives such as detergent sources and rinse aid sources. Such invention is also designed to save on additives and hot water. Also, the dishwashing apparatus is designed in such a way as to save on space and installation costs.

The invention also relates to a flip-top detergent dispenser, designed to hold a particularly shaped detergent container. Said flip-top detergent dispenser is designed in such a manner as to facilitate the safe and convenient insertion and removal of the particularly shaped detergent container into the flip-top detergent dispenser. Said flip-top detergent dispenser is designed only to operate with the particularly shaped detergent container, thus preventing the use of an incompatible and unsafe product in said dishwasher apparatus.

2. Discusshion of Related Technology

Dishwashing apparatuses which make use of solid dishwasing additives such as a solid detergent source and a solid rinse aid source are known in the art. To use such a dishwashing apparatus, water is directed onto each of the solid additives in order to form additive solutions which can be circulated throughout the machine. Such dishwashing apparatuses of the prior art have typically utilized three separate outside waterlines. One waterline served to fill the machine with clean hot water. The other two waterlines directed water through two separate product nozzles onto a solid detergent source and a solid rinse aid source respectively, in order to form a detergent solution and a rinse aid solution.

Due to fluctuations in water pressure in various areas of the country, pressure regulating valves and pressure gauges, in addition to vacuum breakers, had to be used on each of the waterlines directing water through product nozzles onto the solid detergent source and rinse aid source in order that solutions of appropriate concentrations be formed. Thus, in hooking up such a commercial dishwashing apparatus, three outside waterlines had to be used, necessitating the use of three vacuum breakers, three pressure regulating valves, and three pressure gauges.

Also in the dishwashing apparatuses of the prior art, the solid rinse aid and solid detergent source were typically placed in separate containers and mounted on a nearby wall or walls. Thus, the installation of a dishwashing machine of the prior art required a substantial amount of labor. Moreover, the machine, once installed, took up a substantial amount of space in the commercial establishment in which it was used.

In dishwasher apparatuses of the prior art wherein the solid additives were fed off separate outside waterlines, a wasting of the solid detergent source and other additives often occurred. In use, such machines were typically first filled with several gallons of clean, hot water. The separate outside waterline directed to the solid detergent was then opened resulting in the formation of a detergent solution which flowed to the sump of the machine. However, since the machine had already been filled to capacity during the fill cycle, water would run out through the overflow valve as the detergent solution entered the sump. This resulted in a waste of hot water. In addition, some of the detergent solution would run out of the machine along with the hot water. Thus, more detergent solution than necessary had to be transported to the sump in order to make up for the amount lost through the overflow valve. Thus, a wasting of solid detergent occurred.

Inversion type detergent dispensing apparatuses which invert an open upright container of detergent to an inverted position over a nozzle which sprays water into the detergent container in order to produce a detergent solution are known. Known inversion type detergent dispensing apparatuses of the prior art such as those disclosed in U.S. Pat. No. 4,020,865 and U.S. Pat. No. Design 244,598, both assigned to Applicant, relate to powder detergent dispensers useful in converting powder detergent from 5 to 10 cylindrical gallon containers into concentrated detergent solution. The detergent dispenser disclosed in U.S. Pat. No. 4,020,865 is not designed to function only with a particularly designed container as is the present invention, in which only containers having a particular shape including an indentation will cause the flip-top detergent dispenser of the present invention to properly function and water to spray onto the detergent product.

Furthermore, the user of the powder detergent dispenser disclosed in U.S. Pat. No. 4,020,865 must manipulate a locking safety lever assembly out of locking engagement before pivoting the inverted detergent container by means of a cradle assembly into an upright position. the manipulation of the locking safety lever assembly prevents water from spraying through the product nozzle.

SUMMARY OF THE INVENTION

The present invention addresses these problems by providing for a self-contained dishwashing apparatus in which both the solid detergent source and solid rinse aid are mounted directly on top of the machine. This saves both labor for the installers of the dishwashing apparatus and saves space for the commercial establishment in which the dishwashing apparatus is installed.

The present invention also provides for the use of only one outside waterline instead of the more typical three. A main pump which is responsible for circulating water through rotating nozzle arrays contained within the machine also serves to direct pressurized water to a solid detergent source and a solid rinse aid source. The use of a pump to feed water to the solid additive sources eliminates the need for the two extra waterlines of the prior art and also the pressure regulators, pressure gauges and vacuum breakers which were included on each waterline in order to maintain a constant pressure. This results in a substantial cost savings.

The dishwasher apparatus of the present invention also saves on the cost of hot water and additives. After a complete cycle of the dishwasher apparatus of the present invention has been run, the final rinse water which contains both a rinse aid and a sanitizer is retained within the sump of the machine. the user of the dishwasher apparatus can remove the clean dishware from the machine and insert soiled dishware for the start of the second complete cycle. The initial fill cycle which started the first complete dishwasher cycle by running two gallson of clean, hot water into the machine can be skipped at the beginning of this second complete cycle. The second complete cycle instead begins by recirculating the previously used rinse water left over from the first complete cycle through the rotating nozzle arrays and against the solid detergent source. This results in a savings not only of hot water, but also of rinse aid and sanitizer.

The use of the dishwasher apparatus of the present invention also results in a savings of detergent. The solid detergent dispenser mounted on top of the dishwashing machine of the present invention comprises a funnel-shaped metallic holder which serves to hold an inverted container of solid detergent having an opening in such a position as to allow water to spray through a nozzle located in the funnel-shaped metallic holder against the solid detergent in order to produce a detergent solution. Encircling the upper interior edge of the funnel-shaped metallic holder is a circular metallic ring having a plurality of holes. A waterline connected to the ring serves to flush water out through the plurality of holes down into the interior of the funnel-shaped metallic holder into a line leading to the sump of the machine. This flushing action occurs at certain designated times in the dishwasher cycle in order to ensure that any detergent that has conglomerated in the funnel-shaped metallic holder is flushed down the interior of the funnel-shaped metallic holder and transported to the sump. This process helps insure that no wasting of detergent occurs.

Also, the present invention's use of only one outside waterline instead of the more typical three of the prior art results in a savings of additives such as detergent. In the present invention, the additives are fed by a pump with water contained in the sump of the machine rather than outside waterlines. Thus, the problem of losing clean, hot water and additives down through the overflow valve which occurred in machines of the prior art is solved since no additional water is added to the machine to form additive solutions. Rather, additive solutions are formed only by using water which enters the machine during a fill cycle. Thus, no wasting of clean, hot water or additives occurs with the use of the present invention. Furthermore, the dishwashing apparatus of the present invention is designed so that water containing detergent solution will not flow back into the incoming waterline.

The present invention also relates to a flip-top detergent dispenser comprising a base means having a funnel-shaped interior, a nozzle positioned within the interior of the base means, and a detergent container support means connected by a hinge means to said base means. The detergent container support means is designed to hold only a particular shaped detergent container, thus helping to insure that only suitable detergent products are used in the warewashing apparatus. The flip-top detergent dispenser, mounted on top of the dishwashing apparatus, is designed so that the detergent container can be inserted into and removed from the detergent holder support means only in an upright position to prevent dripping of detergent solution onto the user.

The dispenser of the present invention has a safety feature which prevents water from spraying through the nozzle when no detergent container is present which could cause burns to the user. This safety feature of the present invention is more convenient than safety features of known detergent dispensers.

The funnel-shaped metallic holder of the flip-top detergent dispenser is in close proximity to a cam upon which a weight must press with sufficient force before water will be pumped through the solid detergent source product nozzle. This safety feature helps to ensure that hot water is not sprayed out through the funnel-shaped metallic holder unless a particular shaped solid detergent source container is present into which the water will spray. This safety feature helps to prevent burns since water will not spray out through the solid detergent source product nozzle unless the particular shaped solid detergent source container is present to push down the cam. If the user inadvertently forgets to insert the solid detergent source container, then no water will flow through the solid detergent source product nozzle during the cycle, which outerwise could result in burns to the user or other nearby persons.

The detergent container support means of the flip top detergent dispenser can comprise a wire cage assembly. Upon tilting the wire cage assembly of the flip-top detergent dispenser of the present invention from a closed position in which the solid detergent source container is in an inverted position above the nozzle shaped metallic holder to an open position in which the detergent container is in an upright position, a cam which had been pushed down by the detergent container thus causing water to spray through the product nozzle is no longer contacted and thus water will no longer spray through the product nozzle.

In the present invention the water is shut off, thus assuring safety but without having the user manipulate any lever before tilting the wire cage assembly of the flip-top detergent dispenser. The present invention is thus more convenient to use than known detergent dispensers while at the same time preserving a high level of safety by ensuring that water will not spray out of the product nozzle when no detergent container is present. Furthermore, the wire cage assembly of the flip-top detergent dispenser of the present invention permits the user to see the container while it is in the dispenser, thus allowing the user to see and read any warning labels and instructions printed on the container.

To insert the solid detergent source container into the funnel-shaped metallic holder, the wire cage assembly can be pulled downward by the use of a handle located on the top portion of the wire cage assembly from an initial closed upsidedown position to an open upright position. The solid detergent source container can be slipped into the wire cage assembly in its open position such that the solid detergent container is in an upright position with the open mouth of the container facing up. The user of the flip-top detergent dispenser can then push the wire cage assembly back into its initial closed upsidedown position in contact with the funnel-shaped metallic holder by use of the handle located on the wire cage assembly. The solid detergent source container is now resting in an inverted position with the bottom of the solid detergent source container up in the air and the open mouth of the solid detergent source container positioned over the product nozzle positioned in the interior of the funnel-shaped metallic holder.

To remove the solid detergent source container, the user simply pulls down on the handle connected to the wire cage assembly so that the wire cage assembly is in an open upright position and thus, the solid detergent source container which was in an inverted position previously is now right side up. The user can now lock down into the solid detergent source container and see the amount of detergent left. Previously with detergent holders of the prior art, a user would remove the inserted detergent source container by lifting it straight up out of its holder and often times look straight up into the container itself to see how much detergent was left. This was a dangerous practice since drops of detergent solution could flow out of the container resulting in injury to the user's eye. The present invention solves this problem in that the solid detergent source container is removed in an upright position wherein the user can easily look down into the solid detergent source container to see how much detergent is left and therefore must wait until the solid detergent source container is in an upright position before looking into it. This is in contrast to the prior art dispensers in which a user did not have to invert the solid detergent source container into an upright position before looking into it to see how much detergent was present.

Thus, the flip-top detergent dispenser of the present invention has numerous safety features. Automatic safety features include a cam situated next to the base means which will not be activated unless a particularly shaped detergent container is situated in the detergent support holder and the detergent support holder is closed. Only when the cam is activated can water spray up through the product nozzle. Furthermore, spacers in the hinge means of the flip top detergent dispenser help prevent a user from catching or cutting his fingers when opening or closing the flip-top detergent dispenser. Also, preferably, the detergent support holder has open areas so that labels including instructions and warnings can be read on the solid detergent container.

In addition, a circular metallic ring having a plurality of holes is situated around the funnel-shaped interior of the base of the flip-top detergent dispenser. Water is flushed through the holes of the circular metallic ring at designated times in the warewashing cycle serving to insure that the detergent is rinsed down through the funnel-shaped interior of the base and that it does not conglomerate there resulting in a savings of solid detergent source.

BRIEF DESCRIPTION OF THE DRAWINGS

Referring to the Drawings, wherein like numerals represent like parts throughout the several views:

FIG. 3 is a schematic block diagram illustrating the circulatory flow path of the dishwashing apparatus of the present invention disclosed in FIG. 1;

FIG. 4 is a front elevational view of the solid detergent source container means 30 which appears in FIG. 1;

FIG. 6 is a left side elevational view of the solid detergent source container means 30 of FIG. 4;

FIG. 7 is a right perspective view of solid detergent source container means 30 of FIG. 4 containing solid detergent source container 23;

FIG. 8 is an enlargted fragmentary perspective view of solid detergent source container 23 in solid detergent source container means 30;

DETAILED DESCRIPTION OF THE INVENTION

Figure 1:
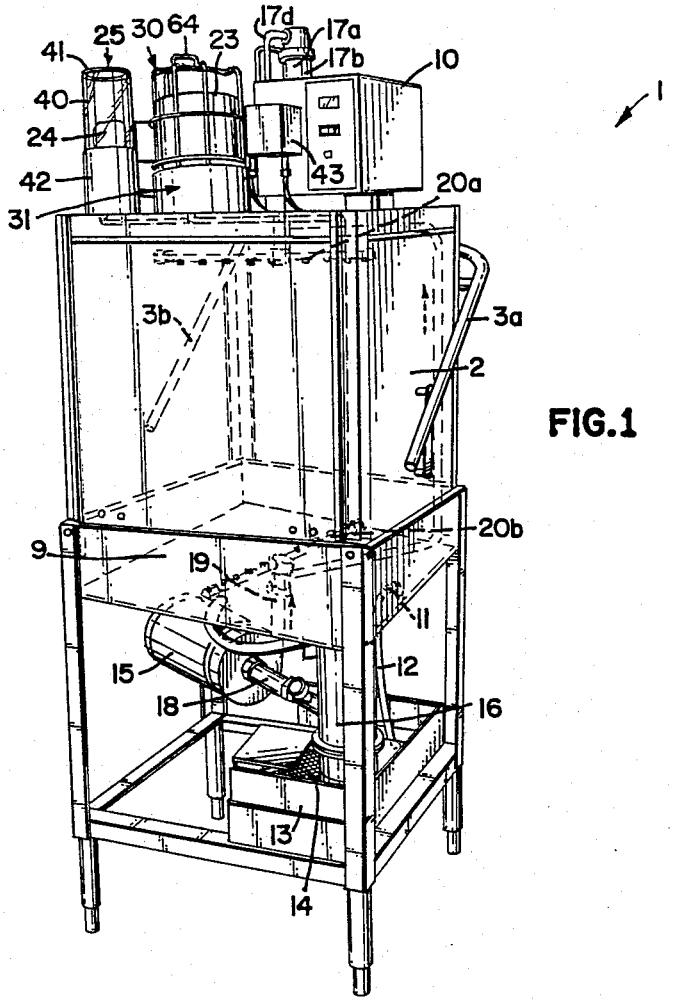
FIG. 1 is a right front perspective view of the dishwashing apparatus of the present invention, with the rotating nozzle arrays 20*a* and 20*b* and lines 19, 36, 39 and 45 indicated by dashed lines.

A description of the warewashing apparatus of the present invention in its operation is as follows:

The warewashing apparatus of the present invention has a typical complete cycle of ninety seconds. The complete cycle comprises a number of shorter individual cycles. The length of the shorter individual cycles comprising the complete cycle and thus the length of the complete cycle itself can be shortened or lengthened. The first individual cycle is the first fill cycle which lasts approximately 14 seconds. The second cycle is the wash cycle which lasts approximately 44 seconds. There is a 5.4 second overlap of the end of the first fill cycle and the beginning of the wash cycle. Main pump 15 is activated throughout the wash cycle. Main pump 15 directs water to rotating nozzle arrays 20*a* and 20*b* and to other areas of machine 1 when appropriate valves are opened. The wash cycle includes the following steps. A pre-flush step lasting 3 seconds rids fine in-line filter 17 of air and flushes water through holes in circular metallic ring 37 situated in the interior portion of funnel-shaped metallic holder 31 which contains solid detergent source container 23. Following the pre-flush step is a detergent solution formation step lasting 2 seconds followed by a final flush step lasting 5 seconds in which water is again directed through the holes in circular metallic ring 37 to rinse to any detergent which has conglomerated in funnel-shaped metallic holder 31.

After the wash cycle is a 13 second drain cycle in which water and debris is drained from the machine 1. Before the end of the drain cycle, a second 14 second fill cycle is initiated. An overlap between the end of the drain cycle and the beginning of the second fill cycle occurs for 3 seconds. This 3 second overlap is termed the flush cycle. During the flush cycle, water enters machine 1 while water is also draining from machine 1.

The final cycle is the rinse cycle which last approximately 21 seconds. During the rinse cycle, chlorine sanitizer is added to sump 9 of machine 1 along with a rinse aid solution which is formed during the rinse cycle. During the rinse cycle, water is directed to rotating nozzle arrays 20*a* and 20*b*. At the end of the rinse cycle, the water containing sanitizer and rinse aid is retained within sump 9 of machine 1.

Figure 10:
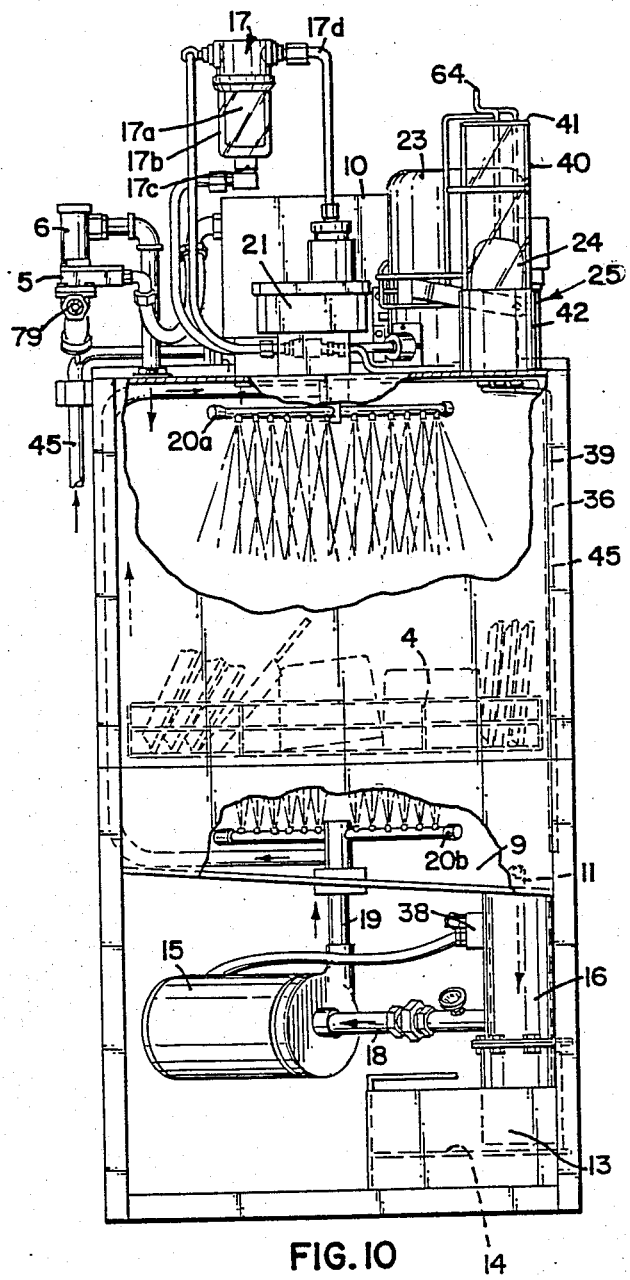
FIG. 10 is a left side elevational view of the dishwashing apparatus of the present invention. Rack 4, coarse-in-line filter 16, metal box 13, lines 19, 36, 39 and 45 are indicated by dashed lines.
Figure 11:
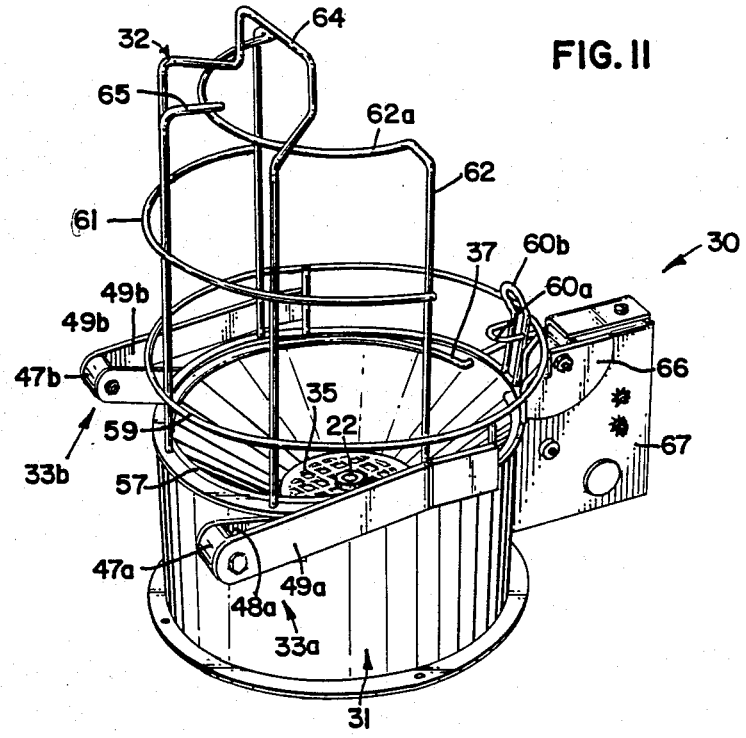
FIG. 11 is a top right perspective view of solid detergent container source means 30 of FIG. 4.

Referring to FIGS. 1 and 10, access is gained to machine 1 by opening door 2 by means of door handles 3*a* or 3*b*. Soiled dishware can then be loaded into machine 1. Once soiled dishware has been properly placed within rack 4 of machine 1 and the system has been energized, the first of two fill cycle begins. referring to FIGS. 1, 3 and 10, solenoid actuated on/off valve 5 opens to allow clean, hot water to flow through vacuum breaker 6 and through line 7 which leads into the top of machine 1 at point 8. The clean, hot water squirts out over the soiled dishware located in rack 4 and collects in sump 9.

Line 7 could be attached to other portions of machine 1 in order to deliver water to sump 9. However, by adding the water at the top of machine 1, it serves to contact the soiled dishware with water, thus serving a rinsing function.

Solenoid actuated on/off valve 5 is operated by means of a cam 72 (not shown) in control cabinet 10 situated on top of machine 1. Cam 72 causes solenoid actuated on/off valve 5 to open for approximately 2–4 seconds allowing enough water through vacuum breaker 6 and line 7 to fill sump 9 with approximately two gallons of water. Electrical line 80 extends from solenoid actuated on/off valve 5 to control cabinet 10.

Overflow valve 11 serves to prevent overfilling of sump 9. Excess water is drained through overflow valve 11 into line 12 which leads from the bottom of sump 9 into metal box 13 which is located beneath machine 1. Metal box 13 contains a perforated horizontal filter 14 which serves to collect food and other debris. Horizontal filter 14 can be manually removed and cleaned. Water draining through overflow valve 11 flows into metal box 13 through horizontal filter 14 and through a line (not shown) leading into the city sewer system.

Before the 2–4 second first fill cycle is complete, main pump 15 is activted by cam 73 (not shown) in control cabinet 10. The water which has collected in sump 9 is drawn by means of main pump 15 through coarse in-line filter 16 which is located beneath sump 9. Coarse in-line filter 16 comprises a perforated metal cylindrical filter enclosed in a cylindrical metal casing. The upper edge of the perforated metal cylindrical filter is sealed to the cylindrical metal casing.

A drain valve (not shown) is attached to the bottom of coarse in-line filter 16. Coarse in-line filter 16 is positioned over metal box 13. The drain valve is not opened until later in the cycle. When the drain valve is opened by means of cam 74 (not shown) in control cabinet 10, all water in machine 1 including the water within sump 9 drains down through coarse in-line filter 16 and fine in-line filter 17, along with any debris that has collected in coarse in-line filter 16 or elsewhere in machine 1, into metal box 13 through horizontal filter 14, into a line (not shown) which leads to the city sewer system. Horizontal filter 14, located in metal box 13, serves to collect food and other debris.

Main pump 15 thus draws the water which has started to collect in sump 9 through line 18, through coarse in-line filter 16, and directs the water through line 19 to rotating nozzle arrays **20*a* and 20*b*. Rotating nozzle array 20*a*, attached to the upper interior surface of machine 1, serves to deposit water down onto the soiled dishware contained in rack 4. Rotating nozzle array 20*b*, situated in sump 9 of machine 1, serves to spray water up against soiled dishware contained in rack 4**.

Figure 2:
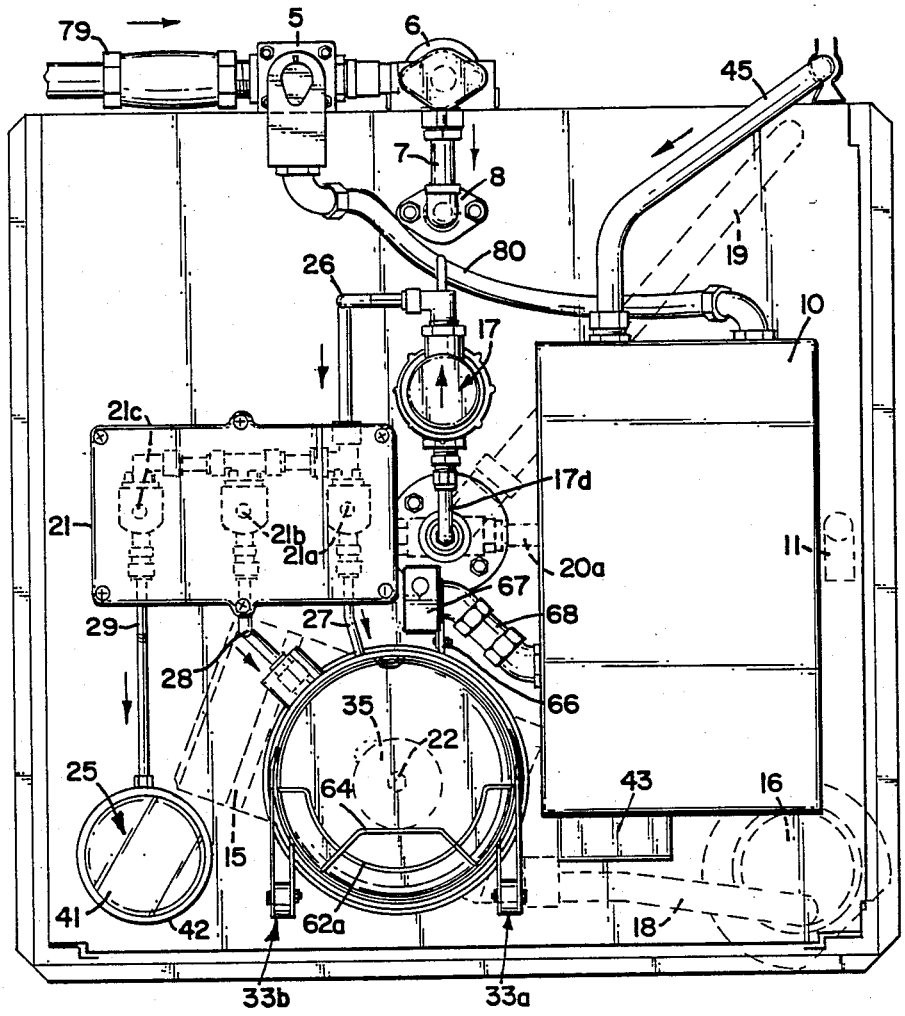
FIG. 2 is a top plan view of the dishwashing apparatus of the present invention disclosed in FIG. 1. Solenoid valves 21*a*, 21*b*, and 21*c*, main pump 15, line 18, line 19, coarse in-line filter 16 and rotating nozzle array 20*a* are indicated by dashed lines.
Figure 9:
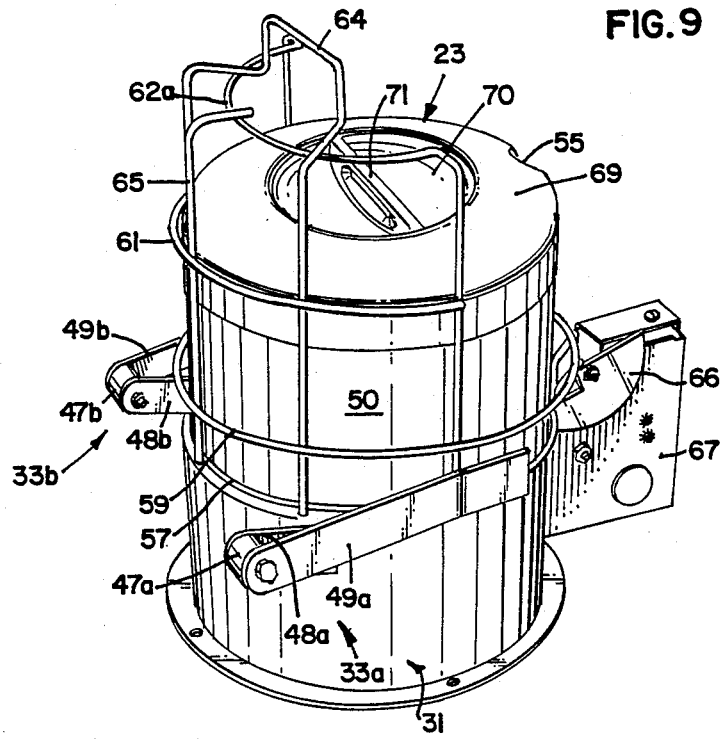
FIG. 9 is a top right perspective view of solid detergent source container means 30 of FIG. 4 containing solid detergent source container 23.

Referring to FIGS. 2 and 3, solenoid valve 21a contained in box 21 is opened by means of cam 75 (not shown) in control cabinet 10 at the same time main pump 15 is activated. The opening of solenoid valve 21a serves two functions. The first function is to allow air to be purged from fine in-line filter 17 situated above machine 1. Fine in-line filter 17 comprises a 40 mesh polyethylene cylindrical screen **17*a* encased within a cylindrical TPX plastic housing 17*b*. Fine in-line filter 17 can be purchased from RON-VIC Company. Fine in-line filter 17 serves to trap food particles which can clog up solenoid valves 21*a*, 21*b*, and 21*c* contained in box 21, product nozzle 22 directed towards a solid detergent source in solid detergent source container 23 and the product nozzle directed toward rinse aid 24 in rinse aid container 25. Water enters fine in-line filter 17 from both the bottom of fine in-line filter 17 at point 17*c* and at the top of fine in-line filter 17 at point 17*d*. Water is pumped across polyethylene screen 17*a* exiting plastic housing 17*b* through line 26**.

The second function of solenoid valve **21*a* is to allow water to be pumped through line 27 to flip-top detergent dispenser 30. Flip-top detergent dispenser 30 comprises a nozzle shaped metallic holder 31 connected to wire cage assembly 32 by hinge means 33**.

The solid detergent source (not shown) is contained within solid detergent source container 23. Solid detergent source container 23 has an opening 34. Solid detergent source container 23, containing solid detergent source (not shown), is positioned in an inverted position over product nozzle 22 contained in funnel-shaped metallic holder 31. Solid detergent source container 23 is situated so that product nozzle 22 sprays water into solid detergent source container 23 through opening 34. A screen grating 35 surrounds nozzle 22 and prevents solid particles of detergent from flowing into line 36 leading to sump 9. Funnel-shaped metallic holder 31, secured to the top of machine 1, serves to hold solid detergent source container 23 in place along with wire cage assembly 32.

Figure 5:
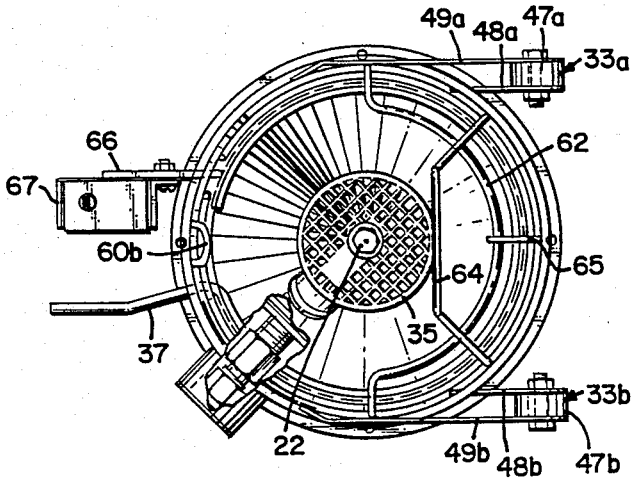
FIG. 5 is a top plan view of the solid detergent source container means 30 of FIG. 4.

Referring to FIGS. 5 and 7, encircling the upper interior edge of funnel-shaped metallic holder 31 is a circular metallic ring 37 containing a plurality of holes (not shown). When solenoid valve **21*a* is opened, water is directed through fine in-line filter 17, through line 26, through line 27, and out through the holes in circular metallic ring 37 down through the interior funnel-shaped metallic holder 31 and into line 36 which lead to sump 9**.

This flushing of water through the holes in circular metallic ring 37 serves to rinse out any detergent material which has collected in the interior of the funnel-shaped metallic holder 31 during a previous detergent solution formation cycle. Solenoid valve **21*a* is initially activated to purge fine in-line filter 17 of air and direct water through perforated circular metallic ring 37 in a preflush step to remove any detergent material left from a previous detergent solution formation cycle around the interior of the funnel-shaped metallic holder 31**.

Immediately after solenoid valve **21*a* is opened and fine in-line filter 17 is filled with water and purged of air solenoid valve 21*a* is closed and solenoid valve 21*b* is activated by cam 76 (not shown) in control cabinet 10 allowing water to flow through line 28 where it is sprayed through product nozzle 22** onto the solid detergent source (not shown).

The action of the water on the solid detergent source results in the formation of a detergent solution which flows through line 36 into sump 9. Solenoid valve **21*b* is then deactivated after 2 seconds have elapsed. Solenoid valve 21*a*** is then reactivated for 5 seconds in a final flush step.

After the detergent solution reaches sump 9, it is pumped out along with any water contained in sump 9 by means of main pump 15 through coarse in-line filter 16 through line 19 to upper and lower rotating nozzle arrays **20*a* and 20*b* where it is sprayed onto dishware located in rack 4 and collects in sump 9 to be recirculated. The water and detergent solution sprayed onto the dishware located in rack 4, collects in sump 9, passes through coarse in-line filter 16 and is recirculated by main pump 15 through rotating nozzle arrays 20***a* and 20*b* for 42 seconds until the wash cycle ends.

The wash cycle ends 42 seconds after the initiation of the first fill cycle. A solenoid valve contained in box 38 connected to the side of coarse in-line filter 16 is activated by cam 74 (not shown) in control cabinet 10 causing water and debris to drain from machine 1 into metal box 13 through horizontal filter 14 into a line (not shown) directed to the city sewer system. Debris contained in coarse in-line filter 16, fine in-line filter 17, and elsewhere in machine 1 exits through a drain valve (not shown) connected to the bottom of coarse in-line filter 17 through metal box 13 located under machine 1 where it is trapped by horizontal screen 14. Horizontal screen 14 can be manually removed and cleaned to remove debris which has collected.

Next, a second fill cycle is initiated by cam 72 (not shown) in control cabinet 10. Clean, hot water again flows through solenoid actuated on/off valve 5, through standard vacuum breaker 6, through line 7, through the top of machine 1 at point 8 spraying onto dishware located in rack 4 and collecting in sump 9.

Approximately two gallons of clean, hot water flows into sump 9 during the second fill cycle. Before the completion of the second fill cycle which lasts approximately 14 seconds, main pump 15 is activated by cam 73 (not shown) in control cabinet 10. Main pump 15 draws water through coarse in-line filter 16 and directs it through line 19 to rotating nozzle arrays 20*a* and 20*b*. Solenoid valve 21*c* is then opened for approximately 6–8 seconds by means of cam 77 (not shown) in control cabinet 10 allowing pressurized water to flow through fine in-line filter 17 at points 17*c* and 17*d*, and out through line 26. The water is then pumped through line 29 and is sprayed by a product nozzle onto rinse aid 24 contained within rinse aid container 25 which is situated on top of machine 1. A rinse aid solution is formed by the contact of water sprayed through the product nozzle onto rinse aid 24. The rinse aid solution thus formed flows through line 39 into sump 9.

Referring to FIGS. 1, 2 and 10, rinse aid container 25 comprises a clear cylinder 40 having a flip-top lid 41, through which the solid rinse aid 24 itself is inserted into rinse aid container 25. The clear cylinder 40 allows the user of the dishwasher apparatus to determine by visual inspection the amount of rinse aid 24 present in the rinse aid container 25.

The base of rinse aid container 25 comprises a cylindrical metal base 42 having a series of four circular screens situated in the top interior portion thereof. The screens vary in coarseness with the top screen being the finest, and each successively lower screen being coarser, the lowest screen being the coarsest. The screens serve to support solid rinse aid 24 in rinse aid container 25. A key-hole shaped hole in the center of cylindrical metal base 42 allows the user to observe line 39 through which rinse aid solution flows into sump 9.

At the same time solenoid valve 21*c* is opened and rinse aid solution is being formed, sanitizer pump 43 is activated by cam 78 (not shown) in control cabinet 10. Referring to FIG. 3, sanitizer pump 43 serves to pump a liquid sanitizer such as chlorine from a container 44 through line 45 into sump 9 at point 46. Sanitizer pump 43 remains on for 6 seconds to allow the addition of 8 milliliters or 50–60 ppm. of chlorine into sump 9. At this point in the cycle, both chlorine sanitizer and rinse aid solution have been added to water contained in sump 9.

Main pump 15 serves to continuously pump water through rotating nozzle arrays 20*a* and 20*b* for the duration of the 18 second rinse cycle. When the rinse cycle is completed, main pump 15 is stopped by means of a cam (not shown) in control cabinet 10. The rinse water which contains both sanitizer and rinse aid is retained within sump 9. The 90 second complete cycle has now been cmpleted. Door 2 of machine 1 can be opened to remove clean dishware from rack 4. Dirty dishware can now be properly inserted in rack 4 of machine 1 in order to begin another cycle.

At the beginning of the next complete cycle, a first fill cycle is not necessary since two gallons of water have been retained in sump 9 from the previous rinse cycle. The second complete cycle is begun by recirculating water containing rinse aid and sanitizer retained in sump 9 from the first complete cycle by means of main pump 15 through coarse in-line filter 16, through line 19 to rotating nozzle arrays 20*a* and 20*b*. Solenoid valve 21*a* is opened to purge fine in-line filter 17 of air and allow water to flow through the holes in circular metallic ring 37. The rest of the second complete cycle is similar to the previously described first complete cycle.

Referring now to FIGS. 4, 5, 6, 7, 8, 9 and 11, flip-top detergent dispenser 30 comprises a wire cage assembly 32 attached to a funnel-shaped metallic holder 31 by hinge means 33*a* and 33*b*. Wire cage assembly 32 provides a means for safely and efficiently inserting a solid detergent source container 23 into a funnel-shaped metallic holder 31.

The flip-top detergent dispenser 30 of the present invention situated on top of machine 1 is designed with numerous safety features. Hinge means 33*a* and 33*b* are designed such that spacers 47*a* and 47*b* are present between stationary flange 48*a* and rotating flange 49*a* and stationary flange 48*b* and rotating flange 49b respectively. Spacers 47*a* and 47*b* help prevent a user from catching or cutting his fingers in hinge means 33*a* and 33*b* when opening and closing the flip-top detergent dispenser.

The flip-top detergent dispenser 30 of the present invention is designed so that it will operate only with a compatible solid deterent source container 23 which is specifically designed to fit within the flip-top detergent dispenser 30. This helps to ensure that only products specifically intended for use in the dishwashing apparatus of the present invention are so used.

The solid detergent source container 23 designed for use in the flip-top detergent dispenser of the present invention comprises a cylindrical portion 50, a funnel-shaped portion 51, and a base portion 52. Funnel-shaped portion 51 extends upwards from cylindrical portion 50. The funnel-shaped portion 51 has an opening 34 in the top center portion thereof an an upwardly extending first rim 53 surrounding opening 34. First rim 53 has threads upon which a cap 54 can be screwed in order to protect the solid detergent source itself and handlers thereof before use. Connected to the opposite end of cylindrical portion 50 of solid detergent source container 23 is a base portion 69, said base portion 69 having a circular indentation 70 therein and a handle 71 extending across the diameter of circular indention 70, said handle 71 connected to said base portion 69 at both ends of handle 71. Handle 71 serves to aid the user in the insertion and removal of solid detergent source container 23 into wire cage assembly 32 of flip-top detergent dispenser 30.

The solid detergent source container 23 itself can be opaque, translucent or transparent. Preferably the solid detergent source container 23 is transparent or translucent so that the user of the warewashing machine apparatus can determine the amount of detergent left merely by observing solid detergent source container 23 when it is in place on machine 1.

Applicant's solid detergent source container 23 is designed having a curved vertical indentation 55 extending along the side of container 23, said vertical indentation 55 extending through approximately two and one-half inches of cylindrical portion 50 and one-half inch of funnel-shaped portion 51. Curved vertical indention 55 is approximately one inch wide, three inches long and one-half inch deep at its deepest portion. Said vertical indentation 55 is perpendicular to handle 71 extending across the diameter of base 69. The placement of handle 71 in relation to indentation 70 is to ensure that when solid detergent source container 23 is properly inserted into wire cage assembly 32 of flip-top dispenser 30, handle 71 on base 69 of solid detergent source container is positioned such that it can be easily grasped by the user of the warewashing apparatus of the present invention.

Solid detergent source container 23 also has a pronounced second rim 56 extending around the upper edge of cylindrical portion 50. Second rim 56 helps to ensure that solid detergent source container 23 does not slide completely through wire cage assembly 32 further than second rim 56 as wire cage assembly 32 is opened and closed by the user. Wire cage assembly 32 catches solid detergent source container 23 at second rim 56 and prevents solid detergent source container 23 from completely sliding through wire cage assembly 32.

Wire cage assembly 32 is attached on either side to rotating flanges 49*a* and 49*b* respectively. Rotating flanges 49*a* and 49*b* are attached to stationary flanges 48*a* and 48*b* respectively. Stationary flanges 48*a* and 48*b* are also attached at their opposite ends to nozzle shaped metallic holder 31. Spacer 47*a* is positioned between rotating flange 49*a* and stationary flange 48*a* and spacer 47*b* is positioned between rotating flange 49*b* and stationary flange 48*b*. Spacers 47*a* and 47*b* help ensure that a user does not cut or catch his fingers in hinge means 33 when opening or closing flip-top detergent dispense 30.

Wire cage assembly 32 comprises a first circular metallic ring 57, said first circular metallic ring 57 positioned to contact funnel-shaped metallic holder 31 when flip-top detergent dispenser 30 is closed, said first circular metallic ring 57 having an opening of approximately one-half inch at point 58, where ends 57*a* and 57*b* of first circular metallic ring extend upward and contact second circular metallic ring 59 at points 59*a* and 59*b* respectively. Second circular metallic ring 59 is of a slightly larger circumference than first circular metallic ring 57.

A double cross bar 60 extending between first circular metallic wire 57 and second circular metallic wire 59 has two inwardly projecting projection means 60*a* and 60*b*. A third wire 61 positioned parallel to and above the first and second circular metallic wires 57 and 59 forms a semi-circular portion of wire cage assembly 32. A fourth wire 62 extends from two points on a diameter of first circular metallic wire 57 and extends upward contacting second circular wire 59, third wire 61, extending above third wire 61 approximately two inches and curving into a semi-circular shape, where it forms a base 62*a* which serves to support the base 69 of solid detergent source container 23 when the flip-top detergent dispenser 30 is in an open position.

Fifth wire 63 extends from point 57*a* and 57*b* of first circular metallic wire 57 upwards contacting second circular metallic wire 59, third wire 61, to points 62*a* and 62*b* of the semi-circle formed by forth wire 62 from which it extends to form handle 64 of wire cage assembly 32. Sixth wire 65 extends from first circular metallic wire 57 at point 57*c* and contacts second circular metallic wire 59 and third wire 61 and extends up to the center of the semi-circular portion of fourth wire 62.

Wire cage assembly 32 has two projection means 60*a* and 60*b* extending inward into the ciruclar space defined by second circular metallic wire 59. Projection means 60*a* and 60*b* correspond in shape to curved vertical indention 55 of solid detergent source container 23. Wire cage assembly 32 has an opening at point 34 defined by second circular metallic wire 59 and ends 57*a* and 57*b* of first circular metallic wires 57. When the flip-top detergent dispenser 30 is closed, and no solid detergent source container 23 is present, the open space 58 in wire cage assembly 32 is positioned over cam 66 in such a manner that it does not contact cam 66. Thus, flip-top detergent dispenser 30 by itself when closed does not function to contact cam 66.

However, when an appropriate solid detergent source container 23 designed for use in said dispenser 30 is inserted into said flip-top detergent dispenser 30 such that projection means 60*a* and 60*b* are lined up with the curved vertical indention 55 of solid detergent source container 23 and said wire cage assembly 32 is closed, said solid detergent source container 23 slides downward through wire cage assembly 32 towards nozzle shaped metallic holder 31 as the wire cage assembly 32 is tilted past the horizontal.

First circular metallic wire 57 is designed with a smaller circumference than second circular metallic wire 59. Thus, solid detergent source container 23 can slide past second circular metallic wire 59 but is stopped by first circular metallic wire 57 at second rim 56 of solid detergent source container 23, said first circular metallic wire 57 having a smaller circumference than the circumference of second rim 56 and cylindrical portion 50 of solid detergent source container 23.

Thus, when wire cage assembly 32 is closed, the top of second rim 56 of solid detergent source container 23 rests on first circular metallic wire 57. Space 58 is now occupied by solid detergent source container 23. As the wire cage assembly 32 and solid detergent source container source 23 are closed, cam 66 is contacted by said solid detergent container 23 which occupies space 58, activating a microswitch enclosed in enclosure 67 allowing water to flow through product nozzle 22. Insulated cable 68 leads from enclosure 67 to control cabinet 10.

The first ciruclar metallic wire 57 serves to catch solid detergent source container 23 as the wire cage assembly 32 is lifted and pushed forward so that solid detergent source container 23 does not come flying out through wire cage assembly 32 as wire cage assembly 32 is closed.

The wire cage assembly 32 is also advantageous in that it allows the user to look through the wire cage assembly 32 at the solid detergent source container 23 to identify the product by means of product labels and to read any directions or warnings printed thereon. Also, preferably solid detergent source container 23 is clear or transparent so that the user can determine the amount of solid detergent source left by looking through the clear or transparent container 23 while container 23 is situated in place on machine 1.

To remove solid detergent source container 23 from wire cage assembly 32, the user first pulls down on handle 64 on wire cage assembly 32 so that wire cage assembly 32 is in an open position. To remove solid detergent source container 23 from now opened wire cage assembly 32, the user merely grasps handle 71 attached to base 69 of solid detergent source container 23 and lifts the solid detergent source container 23 very slightly, tilting the bottom of solid detergent source container 23 towards the user and the top of solid detergent source container 23 away from the user and thus pulling solid detergent source container 23 out of wire cage assembly 32.

To insert solid detergent source container 23 into wire cage assembly 32, the user merely lines up the vertical indentation 55 on solid detergent source container 23 with projection menas 60*a* and 60*b* on wire cage assembly 32 and holding onto handle 71 of solid detergent source container 23 slides solid detergent source container 23 into wire cage assembly 32 by tilting the top of solid detergent source container 23 away from the user and sliding solid detergent source container 23 up into wire cage assembly 32, with projection means 60*a* and 60*b* moving within indentation 55, with base 69 of solid detergent source container 23 sliding back down to rest on the semi-circular portion of wire 62 of wire cage assembly 32.

When flip-flop detergent dispenser 30 is in an open position, the user can slide the upright solid detergent source container 23 out of wire cage assembly 32 according to the previously described method and then look down into the opening of the removed solid detergent source container 23. The solid detergent source container 23 is in an upright position after removal. Thus, a user can immediately look down into the solid detergent source container to determine the amount of solid detergent source left.

If the user had to determine the amount of detergent left in an inverted solid detergent source container not encased in Applicant's flip-top detergent mechanism, the first instinct of the user would be to lift the container straight up and look directly up into the inverted container which could result in damage to the user's eyes from drops of detergent solution present in the solid detergent source container. Thus, the flip-top mechanism detergent dispenser aids the user in that it inverts the solid detergent source container before the user has an opportunity to look into the container.

Other modifications of the invention will be apparent to those skilled in the art in light of the foregoing description. This description is intended to provide concrete examples of an individual embodiment clearly disclosing the present invention. Accordingly, the invention is not limited to this embodiment or to the use of specific elements therein. All alternative modifications and variations of the present invention which fall within the spirit and broad scope of the appended claims are covered.

I claim:

1. A dishwashing apparatus comprising:

(a) a first water access means having a valve and a vacuum breaker, said water access means leading into;

(b) a main container, said main container having a means to access said main container in order to insert and remove dishware, and a sump with a bottom portion, said sump situated in a bottom portion of said main container wherein water and debris can collect in said sump;

(c) a first nozzle positioned within said main container in a manner such that pressurized water directed through said first nozzle would serve to contact dishware contained in said main container;

(d) a self cleaning first filter wherein said self cleaning first filter comprises a perforated cylindrical filter encased in a cylindrical metal casing having an open top portion and an open bottom portion wherein said top portion of said self cleaning first filter is attached top said bottom portion of said sump in a manner which would allow the flow of water and debris from said sump into said first filter by gravity and would allow the flow of water across said perforated cylindrical filter when access from said bottom portion of said first filter is closed by means of a drain valve;

(e) a drain valve attached to the bottom portion of said self cleaning first filter wherein said drain valve when opened would allow the downward flow of water and debris out through the bottom portion of said self cleaning first filter in order to empty said dishwasher apparatus of all water and debris contained therein;

(f) a main pump connected to said self cleaning first filter by;

(g) a second water access means wherein water which has collected in said sump can be pumped by said main pump through said perforated cylindrical filter and through said second water access means;

(h) a third water access means leading from said main pump to said first nozzle and also to a second self cleaning filter, wherein said second self cleaning filter is designed such that water and debris can flow by gravity through said third water access means into said main container when said main pump is deactivated;

(d) a fourth water access means having a valve and extending from said second self cleaning filter and leading to a second nozzle positioned in a solid additive container; said second nozzle positioned such that pressurized water directed through said second nozzle would spray against a solid additive contained in said solid additive container in order to form an additive solution; and (j) a fifth water access means leading from said solid additive container into said main container in order to allow the flow of additive solution into said main container.

2. The dishwashing apparatus of claim 1, which further comprises a water overflow control means.

3. A dishwashing apparatus comprising:

(a) a first water access means having a valve and a vacuum breaker, said water access means leading into;

(b) a main container, said main container having a means to access said main container in order to insert and remove dishware, a sump situated in a bottom portion of said main container wherein water and debris can collect in said sump and a water overflow control means;

(c) a first nozzle positioned within said main container in a manner such that pressurized water directed through said first nozzle would serve to contact dishware contained in said main container;

(d) a self-cleaning first filter wherein said self cleaning filter is attached to a bottom portion of said sump in a manner which would allow the flow of all water and debris from said sump into said first filter by gravity wherein said self cleaning first filter comprises a perforated cylindrical filter encased in the cylindrical metal casing having a top portion and bottom portion wherein said top portion of said self cleaning first filter is attached to the bottom portion of said sump;

(e) a drain valve attached to the bottom portion of said first filter wherein said drain valve when opened would allow the downward flow of water and debris out through the self cleaning first filter in order to empty said dishwasher apparatus of all water and debris contained therein;

(f) a main pump connected to said self cleaning first filter by;

(g) a second water access means wherein water which has collected in said sump can be pumped by said main pump through said perforated cylindrical filter and through said seconds water access means;

(h) a third access means leading from said main pump to said first nozzle and also to a second self cleaning filter wherein said second self cleaning filter is designed such that water and debris can flow by gravity through said third water access means into said main container when said main pump is deactivated;

(i) a fourth water access means extending from said second filter and leading into a fifth and sixth separate water access means, each separate water access means having a valve; said fifth water access means leading into a detergent holder, said detergent holder attached to said main container, said fifth separate water access means leading to a second nozzle located in the interior of said detergent holder positioned such that pressurized water directed through said second nozzle would spray against a detergent source contained in said detergent holder in a solid detergent container having an opening through wich water can spray in order to form a detergent solution, and said sixth separate water access means leading to a third nozzle situated in such a manner as to facilitate contact of solid rinse aid contained in a solid rinse aid container in order to form a rinse aid solution, wherein said solid rinse aid container is attached to said main container, said third nozzle positioned such that water sprayed through said third nozzle would contact said rinse aid in order to form a rinse aid solution;

(k) a seventh water access means leading from said detergent holder into said main container in order to allow the flow of detergent solution into said main container.

4. A dishwashing apparatus comprising:

(a) a first water access means having a valve and a vacuum breaker, said water access means leading into;

(b) a main container, said main container having a means to access said main container in order to insert and remove dishware, a sump situated in a bottom portion of said main container wherein water and debris can collect in said sump and a water overflow control means;

(c) a first nozzle positioned within said main container means in a manner such that pressurized water directed through said first nozzle would serve to contact dishware contained in said main container means;

(d) a self cleaning first filter wherein said self cleaning first filter is attached to a bottom portion of said sump in a manner which would allow the flow of all water and debris from said sump into said first filter of gravity wherein said self cleaning first filter comprises a perforated cylindrical filter encased in a cylindrical metal casing having a top portion and a bottom portion wherein said top portion of said self cleaning filter is attached to said bottom portion of said sump;

(e) a drain valve attached to the bottom portion of said self cleaning first filter wherein said drain valve when opened would allow the downward flow of water and debris out through the self cleaning first filter in order to empty said dishwasher apparatus of all water and debris contained therein;

(f) a main pump connected to said self cleaning first filter by;

(g) a second water access means wherein water which is collected in said sump can be pumped by said main pump through said perforated cylindrical filter and through said water access means wherein said second water access means is attached to an external portion of said cylindrical casing;

(h) a third water access means leading from said main pump to said first nozzle and also to a second self cleaning filter wherein said second self cleaning filter is designed such that water and debris can flow by gravity through said third water access means into said main container when said main pump is deactivated;

(i) a fourth water access means extending from said second filter and leading into a fifth, sixth and seventh separate water access means, each separate water access means having a valve; said fifth and sixth water access means leading to a detergent holder, said detergent holder attached to said main container, said detergent holder having an interior and exterior, said interior having a funnel shape, said detergent holder having a ring extending around the upper interior portion of said holder, said ring having a plurality of holes, said fifth water access means leading to said ring of said interior of said detergent holder such that water directed through said holes in said ring can flow down the sides of the funnel shaped interior of the detergent holder in order to rinse the funnel shaped interior of said detergent holder of any detergent which has splashed on the funnel shaped interior as the result of formation of detergent solution, wherein said detergent solution is formed by directing water through said sixth separate water access means leading to a second nozzle located at a bottom portion of said detergent holder positioned such that pressurized water directed through said second nozzle would spray against a detergent source contained in a solid detergent container positioned within said detergent holder above said second nozzle, wherein said solid detergent container has an opening through which water can spray in order to form a detergent solution, and said seventh separate water access means leading to a third nozzle situated in such a manner as to facilitate contact of a solid rinse aid collected in a solid rinse aid container . said solid rinse aid container means connected to said main container, said third nozzle positioned such that water sprayed through said third nozzle means would contact said rinse aid in order to form a rinse aid solution;

(j) an eighth water access means leading from said rinse aid container into said main container in order to allow the flow of rinse aid solution into said main container; and (k) a ninth water access means leading from said detergent holder into said main container in order to allow the flow of detergent solution into said main container.

* * * * *

UNITED STATES PATENT AND TRADEMARK OFFICE

CERTIFICATE OF CORRECTION

PATENT NO. : 4,836,229

DATED : June 6, 1989

INVENTOR(S) : Haresh C. Lakhan, Lawrence W. Switala, Kim J. Ashton

It is certified that error appears in the above-identified patent and that said Letters Patent is hereby corrected as shown below:

On the first page, under item [75], after "Minneapolis," please delete "both of Minn." and substitute therefore --Kim J. Ashton, Vadnais Heights, all of Minn.--.

In column 3, line 1, delete "gallson" and substitute therefore --gallons--.

In column 4, line 68, delete "lock" and substitute therefore --look--.

In column 5, line 4, delete "serted" and substitute therefore --verted--.

In column 6, line 1, delete "enlargted" and substitute therefore --enlarged--.

In column 6, line 41, delete "to" (second occurrence) and substitute therefore --out--.

In column 6, line 64, delete "referring" and substitute therefore --Referring--.

In column 7, line 28, delete "activted" and substitute therefore --activated--.

In column 10, line 10, delete "cmpleted." and substitute therefore --completed.--.

UNITED STATES PATENT AND TRADEMARK OFFICE

CERTIFICATE OF CORRECTION

PATENT NO. : 4,836,229

DATED : June 6, 1989

INVENTOR(S) : Haresh C. Lakhan, Lawrence W. Switala, Kim J. Ashton

It is certified that error appears in the above-identified patent and that said Letters Patent is hereby corrected as shown below:

In column 11, line 47, delete "dispense" and substitute therefore --dispenser--.

In column 14, line 43, delete "(d)" and substitute therefore --(i)--.

In column 15, line 44, delete "wich" and substitute therefore --which--.

In column 6, line 51, after "last" add --s--.

In column 13, line 64, delete "I" and substitute therefore --We--.

In column 16, line 10, delete "of" and substitute therefore --by--.

Signed and Sealed this

Twenty-fourth Day of April, 1990

*Attest:*

*Attesting Officer*

HARRY F. MANBECK, JR.

*Commissioner of Patents and Trademarks*